US005174732A

United States Patent [19]

Hoya

[11] Patent Number: 5,174,732

[45] Date of Patent: Dec. 29, 1992

[54] VISCOUS FLUID PRESSURE-FEED APPARATUS

[76] Inventor: Takeshi Hoya, 851-1 Oaza Noda,, Iruma-shi, Saitama-ken, Japan

[21] Appl. No.: 702,526

[22] Filed: May 20, 1991

[51] Int. Cl.[5] ..... F04B 43/10; F04B 15/02

[52] U.S. Cl. ..... 417/394; 417/435; 417/900

[58] Field of Search ..... 417/205, 383, 395, 394, 417/435, 478, 900

[56] References Cited

U.S. PATENT DOCUMENTS

| | | | |
|---|---|---|---|
| 3,816,032 | 6/1974 | Flynn | 417/478 |
| 4,604,037 | 8/1986 | Hoya | 417/394 |
| 4,893,992 | 1/1990 | Schlecht | 417/900 |

FOREIGN PATENT DOCUMENTS

| | | | |
|---|---|---|---|
| 180783 | 10/1983 | Japan | 417/435 |

*Primary Examiner*—John J. Vrablik
*Assistant Examiner*—Roland McAndrews
*Attorney, Agent, or Firm*—Browdy and Neimark

[57] ABSTRACT

A viscous fluid pressure-feed apparatus which feeds and drains a slurry of a highly viscous fluid in a casing to a filter press, or the like inside, or outside, an elastic film by pressurizing the elastic film through the feed/drain operation by an oil pressure generation apparatus outside, or inside, the elastic film which is supported by the casing. Particularly, a mechanical press-in apparatus such as a screw feeder is disposed at a suction port of the viscous fluid into the elastic film disposed in the casing so as to operate in synchronism with expansion and contraction of the flexible film and to compulsorily supply the slurry having a high viscosity from a slurry tank. Furthermore, a gas reservoir chamber is added to the casing and a gas exhaust valve is disposed in the gas reservoir chamber. The interior of the casing is sealed through a valve disposed at an outflow port of the press-in apparatus and separation and exhaust of the gas existing in mixture in the slurry of the viscous fluid can be made freely through the opening or closing operation of the exhaust valve. Thus, the pressure-feed apparatus of a viscous fluid of the invention can make high pressure pressure-feed of the viscous fluid.

2 Claims, 3 Drawing Sheets (PRIOR ART)

VISCOUS FLUID PRESSURE-FEED APPARATUS

FIELD OF THE INVENTION

The present invention relates to fluid waste disposal and more particularly to a pressure-feed apparatus used for the disposing of highly viscous fluids such as factory waste fluids, sludges, cement "milk", and so forth.

BACKGROUND OF THE INVENTION

Large quantities of waste matter, waste oils, sludges, and the like are discharged from production factories of various industrial plants as is well known in the prior art. Disposal of these wastes has become a very important measure to be taken against environmental pollution which unavoidably occurs with the development of industry. As to the disposal of highly viscous fluids such as muddy slurries and sludges and the like, technology has been widely employed which provides solid-liquid separation and which disposes of the resulting solid matter by incineration and reclamation, reutilizing the liquid in an appropriate way. Various pressure-feed devices having large-capacity, high-output and high-durability disposing capacities have been used for such disposal purposes.

A pressure-feed apparatus 1 of this kind which has been widely used is shown for example in FIG. 3 of the accompanying drawings. An hydraulic fluid, e.g. oil 5, is supplied by an oil pressure generation apparatus 4 to an elastic film or tube 3 which is stored in a drum-shaped casing 2 and which can be made of a rubber material. The flexible film or tube 3 is pressurized from inside for expansion and contraction in a cyclical operation so that a solution 6 to be disposed, such as a slurry, is sucked from a slurry tank 7 into the casing 2 and is pressure-fed to a processing apparatus 8 of the next stage such as a filter press.

The solid component of the slurry 6 is taken out as a cake by predetermined solid-liquid separation treatment while the liquid component is clarified and is discharged appropriately or reutilized effectively.

If the solution to be disposed is a waste liquid containing chemical agents and/or microorganisms, however, fermentation may occur in the solution if it is stored in the tank for long periods and bubbles come to be mixed in the solution. If the solution to be disposed of is highly viscous, natural deaeration becomes very difficult. If the pressure-feed operation of such a solution is carried out by use of the pressure-feed apparatus 1 described above, the bubbles 10, 10, . . . mix during the suction process because the inside of the casing 2 is closed or opened by a check valve 9 interposed between the casing 2 and the slurry tank 7. Since the bubbles 10, 10 . . . are compressible, they gather and stay inside the casing and cavities are formed locally. Accordingly, even when the elastic film 3 effects a sufficient expansion/contraction operation, the capacity of these cavities changes and the pressure is not transmitted effectively, thereby causing so-called "damping". For this reason, the slurry solution 6 cannot be discharged completely from inside the casing 2 to the processing apparatus 8 of the next stage.

Even if the casing 2 is installed in a vertical arrangement to position suction and discharge ports atop, natural suction of the slurry 6 occurs sometimes. If the slurry 6 is highly viscous, the bubbles 10 are ruptured at the time of suction and a substantial suction quantity of the slurry 6 into the casing 2 becomes insufficient, so that a smooth feed/drain operation of the pressure-feed apparatus 1 cannot be made.

As compression inside the casing 2 is repeated by the operation of the pressure-feed apparatus 1, the temperature of the staying bubbles 10 rises. The rising temperature causes the problem of the pressure-feed apparatus 1 reaching a high temperature such that packings and the like interposed in the connection portions of pipings become fatigued and/or their service life is reduced.

For the reasons described above, in a so-called "plunger type" pressure-feed apparatus, the solutions to be disposed are limited to those which do not contain modifying materials or bubbles, and the pressure-feed apparatus cannot dispose of all kinds of waste liquids including highly viscous liquids.

Because the slurry 6 is sucked and discharged between the elastic film 3 and the casing 2 outside the elastic film 3, the highly viscous liquid cannot be sucked efficiently by the negative pressure in the contraction process of the elastic film 3 at the time of suction. Another problem is the occurrence of folding of the elastic film 3 which is likely to cause its own fatigue.

SUMMARY OF THE INVENTION

It is the primary object of the present invention to overcome problems and deficiencies of the prior art, such as those noted above.

It is another object of the present invention to make it possible to feed reliably under a high pressure to a next process stage, not only waste liquids and sludges discharged from various factories and construction sites, but also those highly viscous fluids which contain bubble formation components when they are stored for long periods such that they cannot be deaerated easily.

It is yet another object of the present invention to make it possible to feed and drain such liquids efficiently by a plunger or flexible film inside a casing.

It is a further object of the present invention to provide an excellent viscous fluid pressure-feed apparatus which will be useful in the field of environmental pollution prevention technology.

To solve those various problems which are encountered during the pressure-feed operation of viscous fluids by use of the pressure-feed apparatus in accordance with the prior art technique described above, the present invention makes it possible to feed reliably under a high pressure to a next process stage, not only waste liquids and sludges discharged from various factories and construction sites, but also those highly viscous fluids which contain bubble formation components when they are stored for long periods such that they cannot be deaerated easily.

BRIEF DESCRIPTION OF THE DRAWINGS

Other objects and advantages of the present invention will become apparent from the following detailed description of the preferred embodiments taken in conjunction with the accompanying drawings, and wherein like reference numerals will be used to identify constituents similar to those of the prior art FIG. 3, in which.

DETAILED DESCRIPTION OF THE PREFERRED EMBODIMENTS

Figure 1:
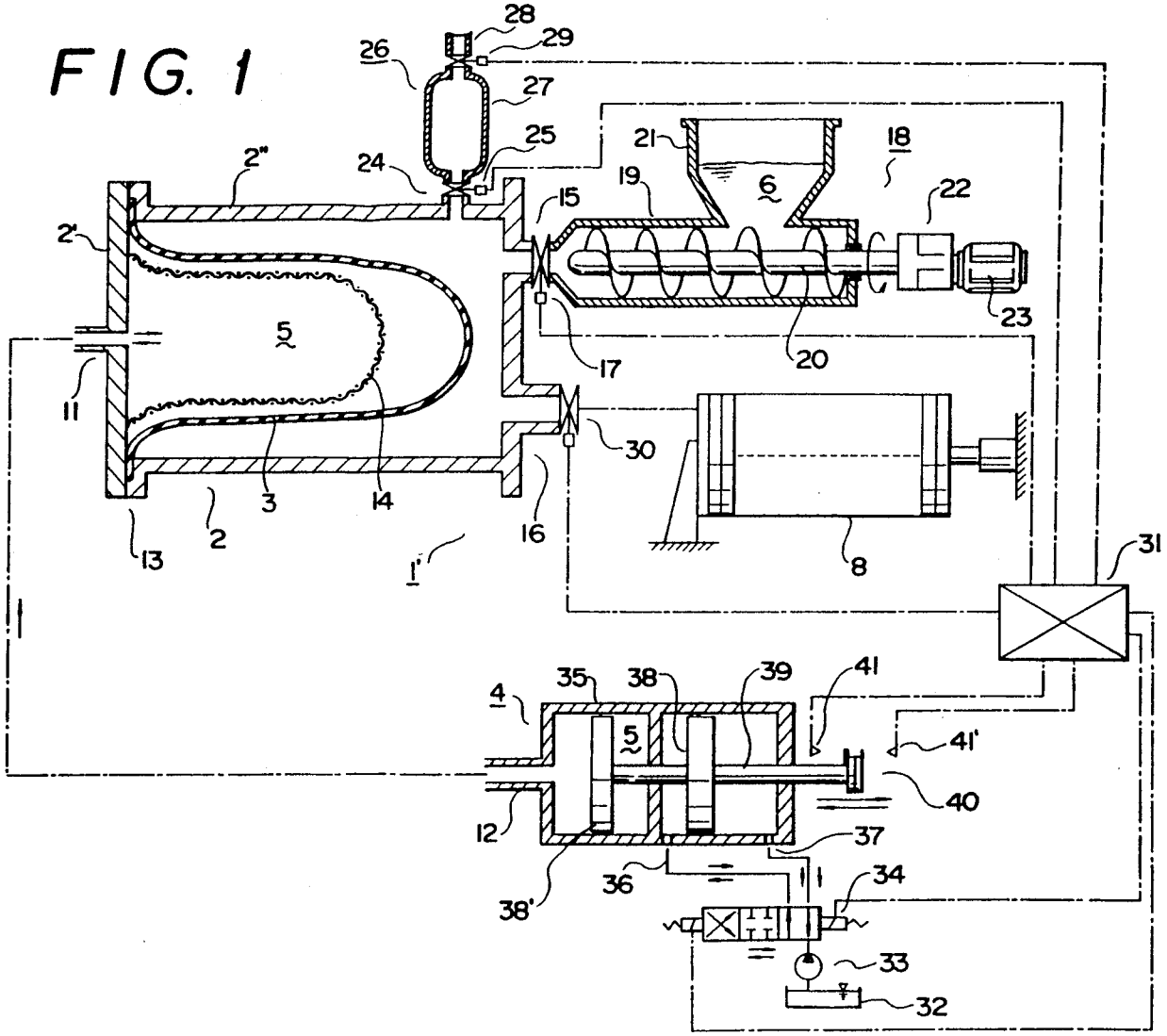
FIG. 1 is an overall schematic sectional view of an embodiment of the present invention.

In the embodiment shown in FIG. 1, reference numeral 1' represents a pressure-feed apparatus which constitutes one of the preferred embodiments of the present invention. An oil feed/drain port 11 for an hydraulic fluid, e.g. operation oil 5, is disposed on one side 2' of a drum-shaped casing 2 of the pressure-feed apparatus, and is connected to a predetermined oil pressure generation apparatus 4' through its output port 12.

The base portion of the casing 2 has the shape of a bottomed cylinder and a flange 13 is disposed integrally therewith. An expandable type flexible and/or elastic film or tube 3 which can be made of a rubber material is clamped to and supported by the casing at its skirt portion through rings with its elastic portion facing inside the casing 2.

Reference numeral 14 represents an outside rigid support net for the retreating posture or position of the elastic film 3 and the base portion of this support net 14 is fixed to the casing 2 so as to retain the shape of the elastic film 3 at the time of contraction.

A feed port 15 and a drain port 16 for a viscous fluid as a solution to be disposed are disposed at predetermined positions on the bottom or side of the casing 2 and a solenoid valve 17 is interposed between the feed port 15 through an appropriate packing and a press-in device 18 connected to and supported by the feed port 15.

The press-in device 18 is equipped with a screw feeder 20 inside its gun type case 19 and a hopper 21 is formed integrally with the upper portion of the case 19. A highly viscous slurry 6 such as cement milk, for example, is always charged into this hopper 21 in such a manner as to supply the highly viscous slurry 6 between the inside of the casing 2 and the elastic film 3 with the tip portion of the screw feeder 20 facing the feed port 15.

Incidentally, the highly viscous slurry 6 inside the casing 2 is discharged to a processing apparatus 8 of the next stage such as a filter press via the drain port 16.

Accordingly, the highly viscous liquid 6 is supplied and discharged inside the elastic film or tube 3 in the casing 2 whereas the operation oil 5 is supplied and discharged outside the elastic film or tube 3.

The screw feeder 20 is connected to a motor 23 through a reduction device 22 and a control construction may be selected arbitrarily so that the motor 23 may be always rotated alternatively, or only driven when the solenoid valve 17 is open.

A gas exhaust port 24 is formed at the top of the casing 2 in the proximity of the feed port 15 and a solenoid controlled valve 25 used as a gas exhaust valve is fitted through a suitable packing. A gas exhaust device 26 operating as a gas reservoir is connected to communicate with the gas exhaust port 24.

The gas exhaust device 26 is connected to the casing 2 at the lower end of a chamber 27 which serves as the gas reservoir chamber having a predetermined capacity. A gas exhaust pipe 28 is formed at the upper end of the gas exhaust device 26 and solenoid valve 29 is fitted to this gas exhaust valve 28.

A solenoid valve 30 is fitted to the drain port 16 of the casing 2 and the processing apparatus 8 of the next stage such as a filter press is connected to it through a predetermined piping.

The solenoid valves 17, 25, 29, 30 are connected electrically to a predetermined controller 31, which also controls the operation of the oil pressure generation apparatus 4.

The hydraulic pressure generation apparatus 4 is a redoubling device of a piston type. Namely, the operation oil 5 supplied from an oil tank 32 through a pump 33 is supplied to inflow-outflow ports 36, 37 of a cylinder 35 through the operation of a direction control solenoid valve 34 controlled by the operation controller 31. As the pistons 38, 38' are moved back and forth at a predetermined speed, the pressure oil 5 is supplied into the casing 2 of the pressure-feed apparatus 1'. Its timing control is made by transmitting the signals which are detected by the operation of limit switches 41, 41' for the dog 40 disposed at the rear end of a piston rod 39 to the controller 31.

In the construction described above, it will be assumed that the highly viscous slurry 6 contains bubbles in mixture as the solution to be disposed is pressure-fed into the filter press 8 by use of the pressure-feed apparatus 1'. When the switch of the controller 31 is turned on, the oil pressure generation apparatus 4 is actuated to start the pump 33, the direction control solenoid valve 34 is reset to the initial state, the operation oil 5 is pressure-fed to the inflow port 37 of the cylinder 35 and the pistons 38, 38' are moved back and forth.

When the dog 40 of the piston rod 39 strikes the limit switch 41, the controller 31 changes over next the direction control solenoid valve 34 so as to move back the pistons 38, 38'.

The piston 38' sucks the operation oil 5 into the large capacity cylinder 35, applies the negative pressure to the feed/drain port 11 on one (2') side of the casing 2 connected thereto through the port 12, and reduces the pressure of the pressurizing chamber defined outside the slurry chamber inside the elastic film 3 by the retreat expansion of the elastic film 3 to prepare for the suction of the slurry 6.

The highly viscous liquid slurry 6 is extruded to the feed port 15 of the casing 2 by the rotation of the screw feeder 20 of the press-in apparatus 18.

The controller 31 opens the solenoid valve 17 fitted to the feed port 15, operates the oil pressure generation apparatus 4 so as to move back the pistons 38, 38' and to discharge the operation oil 5 from inside the casing 2 and thus contracts the elastic film 3 so as to increase the capacity of the slurry chamber.

Incidentally, at this point the controller 31 functions so as to open the solenoid valve 30 disposed in the slurry drain port 16 of the casing 2, the solenoid valve 29 of the gas exhaust apparatus 26 and the solenoid valve 25.

In the suction process of the highly viscous slurry 6 by the pressure-feed apparatus 1', the highly viscous slurry 6 is supplied into the slurry chamber by a kind of push-pull operation by the pressure reduction of the slurry chamber due to the retreat of the elastic film 3 and extrusion of the highly viscous slurry 6 by the press-in apparatus 18. The bubbles 10, 10, . . . existing in mixture in the highly viscous slurry 6 are not ruptured but are caused to flow smoothly into the casing 2 of the pressure-feed apparatus 1' by the retreat of the elastic film 3 and the feed operation of the press-in apparatus 18 which is synchronous with the former.

Some of the bubbles 10, 10, . . . staying inside the casing 2 tend to rise during the feed process into the casing 2 and move near to the gas exhaust port 24. Thus, the controller 31 next opens the solenoid controlled exhaust valve 25 of the gas exhaust apparatus 26 so as to introduce such bubbles 10, 10, . . . into the chamber 27. The highly viscous slurry 6 is packed into the casing 2 and the retreating motion of the elastic film 3 is completed. The dog 40 of the piston rod 39 of the oil pressure generation apparatus 4 strikes the limit switch 41' and its signal is transmitted to the controller 31.

The controller 31 thus controls the oil pressure generation apparatus 4 to move the pistons 38, 38' forward and to supply the operation oil 5 into the pressurizing chamber the volume of which is in part defined by the elastic film 3 inside the casing 2 and, at the same time, opens the solenoid valve 25 disposed in the gas exhaust apparatus 26 as mentioned above. Accordingly, the gas inside the casing 2 is compressed and pushed into the chamber 27 of the gas exhaust apparatus 26.

The solenoid valve 25 of the gas exhaust apparatus 26 is opened with predetermined timing. The oil pressure generation apparatus 4 strongly inflates the elastic film 3 so as to press the highly viscous slurry 6 inside the slurry chamber. The solenoid valve 30 disposed at the drain port 16 is opened and highly viscous slurry 6 is pressure-fed into the filter presses 8 while the gas inside the chamber 27 is discharged as the solenoid valve 29 disposed in the exhaust pipe 28 is opened.

Here, those bubbles 10, 10, . . . which rise inside the casing 2 without passing through the drain port 16 during the contraction process of the elastic film 3 stay at the upper portion inside the casing 2 but are discharged when the solenoid controlled exhaust valve 25 is opened at the initial stage of the next feed/drain process because of the location of the gas exhaust apparatus 26.

Since the bubbles 10, 10, . . . are removed from the highly viscous slurry 6 in the interim, the press/discharge operation for the highly viscous slurry 6 can be carried out reliably.

The bubbles 10, 10, . . . existing in mixture in the highly viscous slurry 6 are removed from the slurry 6 and discharged outside the casing 2 during the pressure-feed operation of the highly viscous slurry 6 to the filter press 8. A predetermined quantity of slurry 6 is pressure-fed at a high pressure in each cycle.

As the process described above is repeated, solid-liquid separation of the highly viscous slurry 6 is efficiently effected.

Figure 2:
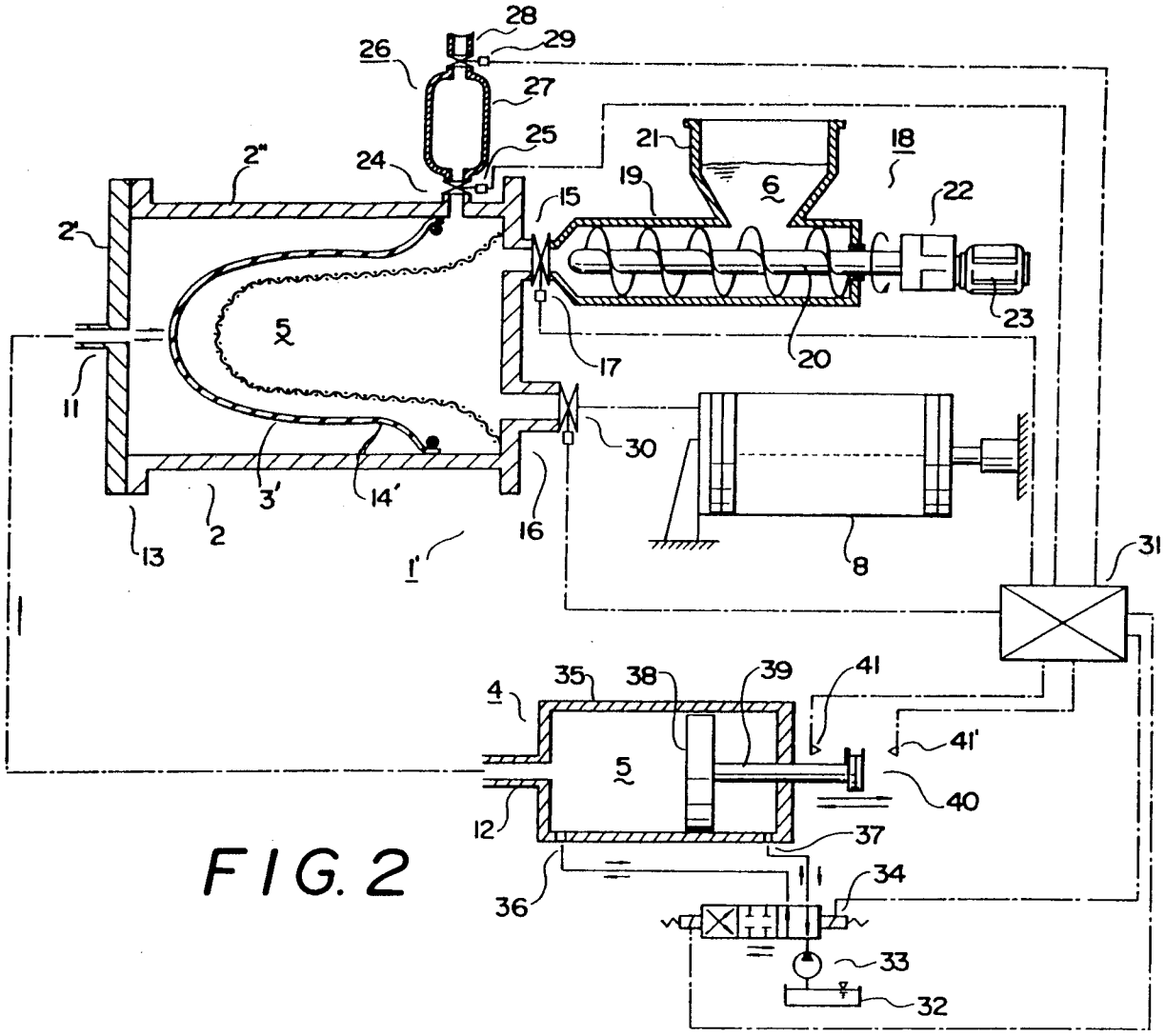
FIG. 2 is an overall schematic sectional view of another embodiment of the present invention.
Figure 3:
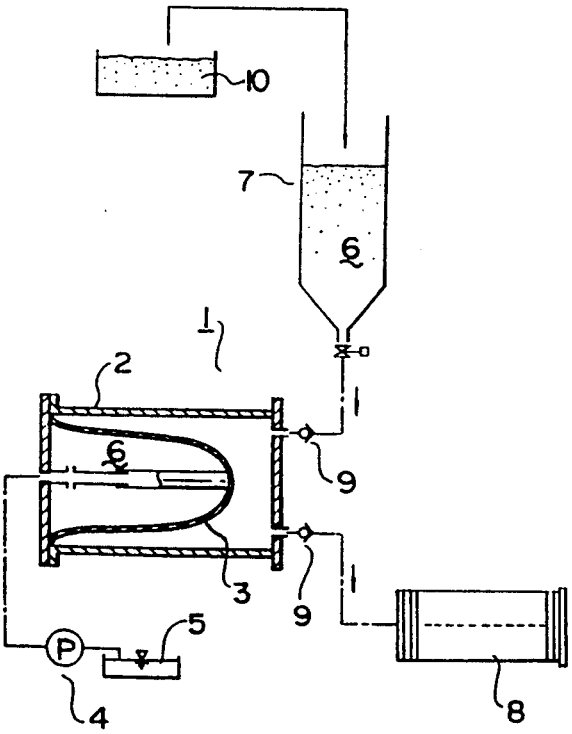
FIG. 3 is an overall schematic sectional view of a prior art apparatus.

In comparison with the embodiment shown in FIG. 1, the embodiment shown in FIG. 2 has the structure wherein the direction of the elastic film 3' and the support 14' inside the casing 2'' and their arrangement direction are opposite and the rigid support net 14' retains the shape of the elastic film 3' at the time of contraction of the latter.

The bubble-removing operation at the time of feed and drain of the highly viscous slurry 6' to and from the casing 2' due to expansion and contraction of the elastic film 3' is the same as in the embodiment described above.

Incidentally, the mode of practicing the present invention is not limited to the embodiments described above. Various other modes, such as one where the gas reservoir chamber discharges the viscous fluid, can be employed, for example.

The apparatus of the present invention can pressure-feed sufficiently an ordinary slurry, cement milk, and the like.

The apparatus in accordance with the present invention basically has a construction wherein the gas reservoir chamber is added to a pressure-feed apparatus used for disposing various sludges and waste liquid so as to compulsorily pressure-feed the highly viscous slurry into the casing. The exhaust valve of the gas reservoir chamber is opened or closed in synchronization with the feed/drain operation of the highly viscous slurry. Accordingly, those bubbles which receive repeatedly the compression and suction of the highly viscous slurry due to expansion and contraction of the elastic film inside the casing, move upward and stay at the upper portion of the casing, and are separated as the gas component from the solution to be processed such that the highly viscous slurry can be pressure-fed to the separation apparatus such as a filter press.

The highly viscous slurry is supplied into the casing by the press-in apparatus. The bubble components, existing in mixture in the solution to be processed at the time of suction into the casing, rise inside the casing during the discharge process of the elastic film, are collected and discharged into the gas reservoir chamber and are thereafter discharged outside the casing by the exhaust apparatus.

Accordingly, the gas no longer exists in the solution to be processed, the high pressure pressure-feed operation due to expansion and contraction of the elastic film can be conducted efficiently and working the efficiency of the feed/drain operation can be improved.

Even when the expansion and contraction of the elastic film is conducted repeatedly, the bubbles are not compressed during the high pressure pressure-feed operation and exothermy does not occur inside the casing, such that degradation of accessorial components such as packings can be prevented.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. In a viscous fluid pressure-feed apparatus in which an expandable elastic film is interposed in a casing between one side of the casing communicating with an output port of an oil pressure generation apparatus and the other side of said casing communicating with a viscous slurry tank and with a piping of a separation apparatus, the improvement wherein a press-in apparatus is disposed between said slurry tank and said casing so as to face inside of said elastic film, and wherein a gas reservoir chamber is connected to said casing, wherein an exhaust valve of said gas reservoir chamber is connected electrically to a valve disposed at an outflow port of said press-in apparatus through a controller.

2. The viscous fluid pressure-feed apparatus of claim 1, wherein said press-in apparatus is a screw feeder.

* * * * *